US008398533B2

(12) United States Patent
Tsunoda

(10) Patent No.: US 8,398,533 B2
(45) Date of Patent: Mar. 19, 2013

(54) PAPER FOLDING APPARATUS AND POSTPROCESSING APPARATUS USING THE SAME

(75) Inventor: Akira Tsunoda, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 361 days.

(21) Appl. No.: 12/818,829

(22) Filed: Jun. 18, 2010

(65) Prior Publication Data

US 2010/0323869 A1 Dec. 23, 2010

(30) Foreign Application Priority Data

Jun. 18, 2009 (JP) ..... 2009-145299

(51) Int. Cl.
*B31B 1/56* (2006.01)

(52) U.S. Cl. ..... 493/454; 493/396; 493/401

(58) Field of Classification Search ..... 493/396, 493/397, 399, 401, 451, 454, 456
See application file for complete search history.

(56) References Cited

U.S. PATENT DOCUMENTS

| | | | | |
|---|---|---|---|---|
| 4,137,803 | A * | 2/1979 | Goldinger | 83/881 |
| 4,694,722 | A * | 9/1987 | Collier et al. | 83/885 |
| 5,067,700 | A | 11/1991 | Dick | |
| 7,028,598 | B2 * | 4/2006 | Teshima | 83/879 |
| 2005/0105988 | A9 * | 5/2005 | Trovinger et al. | 412/16 |
| 2008/0061489 | A1 | 3/2008 | Kawata et al. | |
| 2008/0252062 | A1 | 10/2008 | Kelley | |
| 2009/0100978 | A1 | 4/2009 | Von Freden | |

FOREIGN PATENT DOCUMENTS

| | | | |
|---|---|---|---|
| EP | 1 568 507 | A1 | 8/2005 |
| EP | 1 982 941 | A2 | 10/2008 |
| JP | 55-044024 | | 11/1980 |
| JP | 2962862 | B2 | 10/1999 |
| JP | 2000-272823 | A | 10/2000 |
| JP | 2008-105316 | | 5/2008 |

OTHER PUBLICATIONS

Office Action (Notification of Reason for Refusal) dated Apr. 12, 2011, issued in the corresponding Japanese Patent Application No. 2009-145299, and an English Translation thereof.

European Search Report issued on Sep. 6, 2010 by the European Patent Office in the corresponding EPC Application No. 10166136.1-1256.

* cited by examiner

*Primary Examiner* — Hemant M Desai
(74) *Attorney, Agent, or Firm* — Buchanan Ingersoll & Rooney P.C.

(57) ABSTRACT

A paper folding apparatus includes a ruling unit that rules a line on each of sheets, a pushing unit that pushes the sheets on which the lines are ruled by the ruling unit, and a pair of folding rollers that comes into contact under pressure with the sheets pushed by the pushing unit and discharges the sheets. The ruling unit includes a plurality of pressing blades for ruling a line on each of the sheets, a swinging unit that swings the pressing blades from a pressing position where the pressing blade presses the sheets to a retracted position where the pressing blades are retracted from the sheets, and a moving unit that moves the pressing blades and the swinging unit along the sheets.

11 Claims, 10 Drawing Sheets

PAPER FOLDING APPARATUS AND POSTPROCESSING APPARATUS USING THE SAME

This application is based on application No. 2009-145299 filed in Japan on Jun. 18, 2009, the contents of which are hereby incorporated by reference.

BACKGROUND OF THE INVENTION

1. Field of the Invention

The present invention relates to a postprocessing apparatus such as a printer and an MFP, and more particularly to a paper folding apparatus that rules a line on each of sheets and folds the sheets at a preprocessing stage for forming a saddle-stitched booklet using the sheets after image forming, and the invention also relates to a postprocessing apparatus using the paper folding apparatus.

2. Description of the Related Art

Conventionally, as a method for folding a batch of sheets into a booklet form after saddle stitching by a postprocessing apparatus, there is known a technique in which a binding position is pressed by a chopper, the batch of sheets is pushed into a nip of rollers, and a crease is formed by a pressing force of the rollers. According to this technique, however, since the booklet swells, the appearance and ease of use are inferior and many booklets can not be loaded. There is also a problem that in the case of cardboards or paper sheets that curl outward, even if crease is formed, the sheets can not be formed into the booklet form and open.

To suppress the swelling of the booklet, there is proposed a paper folding apparatus that previously rules a line at a predetermined position of a sheet in a preprocessing of booklet folding operation.

For example, Japanese Patent Application Laid-open No. 2000-272823 describes a paper folding apparatus that rules one straight line on a paper sheet while sandwiching the sheet between a first ruling roller having a groove of V-shaped cross section and a second ruling roller having an angular projecting central portion and carrying the sheet and then, folds the sheet.

Japanese Patent No. 2962862 describes a stitching/folding apparatus provided with a paper folding apparatus having a line-pressing portion having a line-pressing blade for ruling a line on a sheet-like work and a receiving blade placed below the sheet-like works for receiving a pressing force of the line-pressing blade. In the apparatus, the sheet-like works are continuously supplied one-sheet by one-sheet to the line-pressing portion so that one line is ruled on the sheet-like work and then the sheet-like work is fold.

In any of the paper folding apparatuses described in above publication and patent, since the number of line is one, if the number of sheets of paper of the batch is increased, even if the plurality of sheets are positioned for making a booklet, the positions of the lines formed on the sheets are misaligned. Thus, there is a problem that a ruling effect can not be obtained so much when the sheets are bound and folded.

On the other hand, a paper folding apparatus that always rules a plurality of lines has a problem that even when the number of a batch of sheets is as small as one to three, a plurality of creases are formed in a booklet, and the appearance of the booklet is inferior.

SUMMARY OF THE INVENTION

A paper folding apparatus of the present invention includes:

a ruling unit that forms a line on sheets of paper, a pushing unit that pushes the sheets on which the line is formed by the ruling unit, and a pair of folding rollers that come into contact under pressure with the sheets pushed by the pushing unit and that discharge the sheets in this state, wherein the ruling unit includes:

a plurality of pressing blades for forming the line on the sheets, a swinging unit that swings the pressing blades from a pressing position where the sheets are pressed to a retracted position where the pressing blades are retracted from the sheets, and a moving unit that moves the pressing blades and the swinging unit along the sheets.

DETAILED DESCRIPTION OF THE PREFERRED EMBODIMENTS

Next, an embodiment of the present invention will be described in detail with reference to the accompanying drawings.

Figure 1:
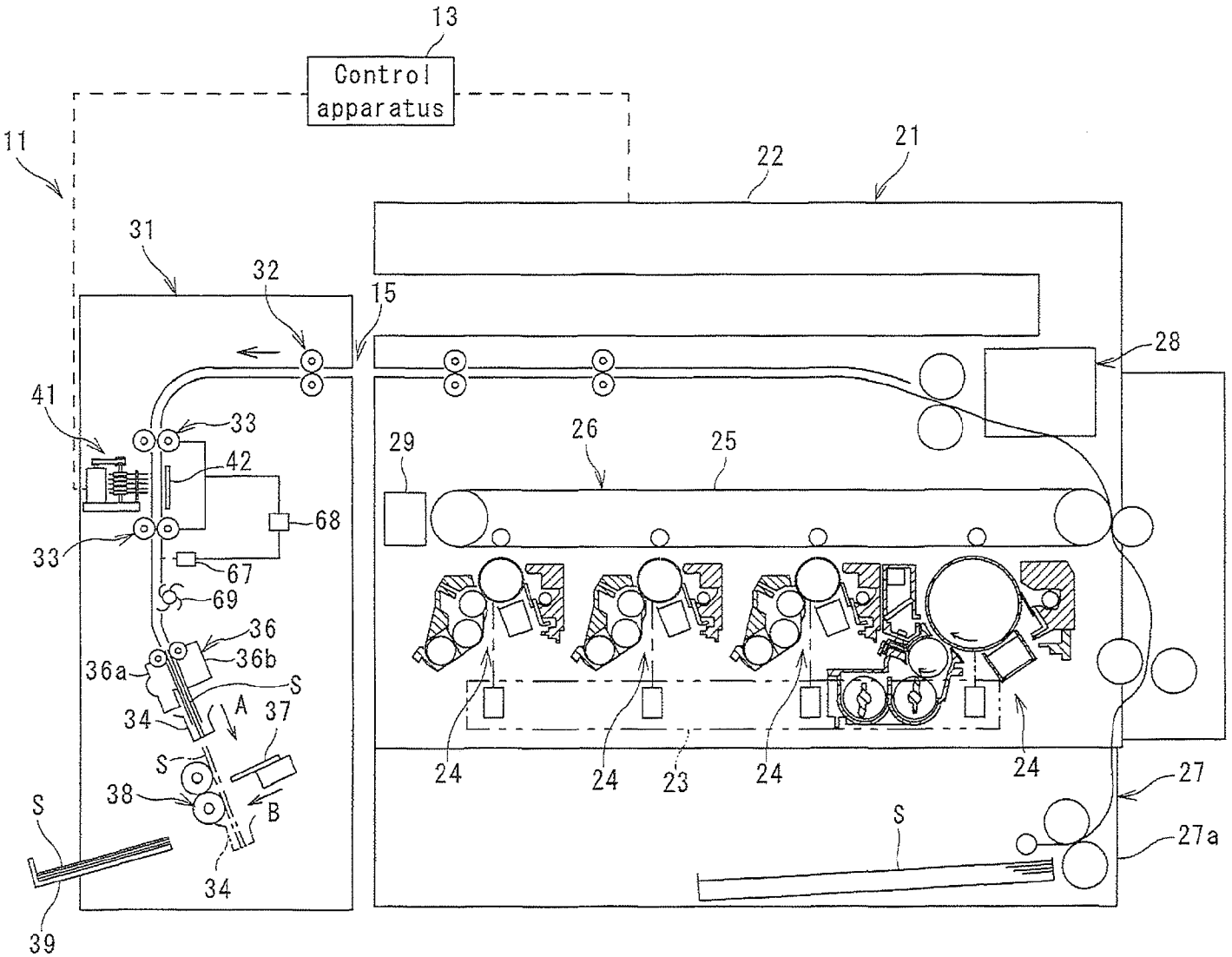
FIG. 1 is a schematic diagram of a paper folding apparatus and an image forming apparatus including a postprocessing apparatus using the paper folding apparatus according to an embodiment of the present invention.

FIG. 1 shows an image forming apparatus 11 having a paper folding apparatus according to the present invention. The image forming apparatus 11 includes a main body 21 that forms a toner image on a sheet S based on input data, and a postprocessing apparatus 31 that carries out a predetermined postprocessing such as a stapling operation for the sheet S with the toner image which was discharged from the main body 21.

The main body 21 includes an image reading unit 22 that reads a original image, an exposure unit 23 that forms an electrostatic latent image corresponding to image data that was read by the image reading unit 22, image forming units 24 that develop the electrostatic latent image and forms images of toner of Y (yellow), M (magenta), C (cyan) and K (black), a transfer unit 26 that transfers a color image formed by the image forming units 24 to a sheet S by an intermediate transfer belt 25, a sheet-feeding unit 27 that conveys the sheets S accommodated in a sheet-feeding cassette 27*a* to a fixing unit 28, and a cleaning unit 29 that recovers the toner remaining on the intermediate transfer belt 25 and cleans the belt 25. A control apparatus 13 is connected to the image reading unit 22. Information such as sizes of originals read by the image reading unit 22, and the number of sheets to be copied that are input by a known input apparatus (not shown) are input to the control apparatus 13.

The postprocessing apparatus 31 includes a pair of delivering rollers 32 that convey a sheet S discharged from the main body 21 into the postprocessing apparatus 31, a ruling apparatus (ruling unit) 41 that rules lines 16 (see FIG. 11) on the conveyed sheets S one-sheet by one-sheet, conveying rollers 33 provided upstream and downstream of the ruling apparatus 41, a stacker 34 that temporarily collects the sheets S with the lines 16 and conveys the sheets S, a staple unit 36 that carries out the stapling operation for a batch of a predetermined number of sheets S collected in the stacker 34, a chopper 37 that is a pushing unit for pushing the batch of sheets S stapled and conveyed by the stacker 34, a pair of folding rollers 38 that discharge the batch of sheets S pushed by the chopper 37 while coming into contact with the batch under pressure, and an output tray 39 in which the discharged batch of sheets S is accommodated. The ruling apparatus 41, the chopper 37 and the folding rollers 38 constitute the paper folding apparatus according to the invention that folds a batch of sheets S.

The delivering rollers 32 are provided most upstream of the postprocessing apparatus 31. The pair of delivering rollers 32 are known rollers rotating around their axes, and sandwich a sheet S to convey the sheet S downstream.

Figure 2:
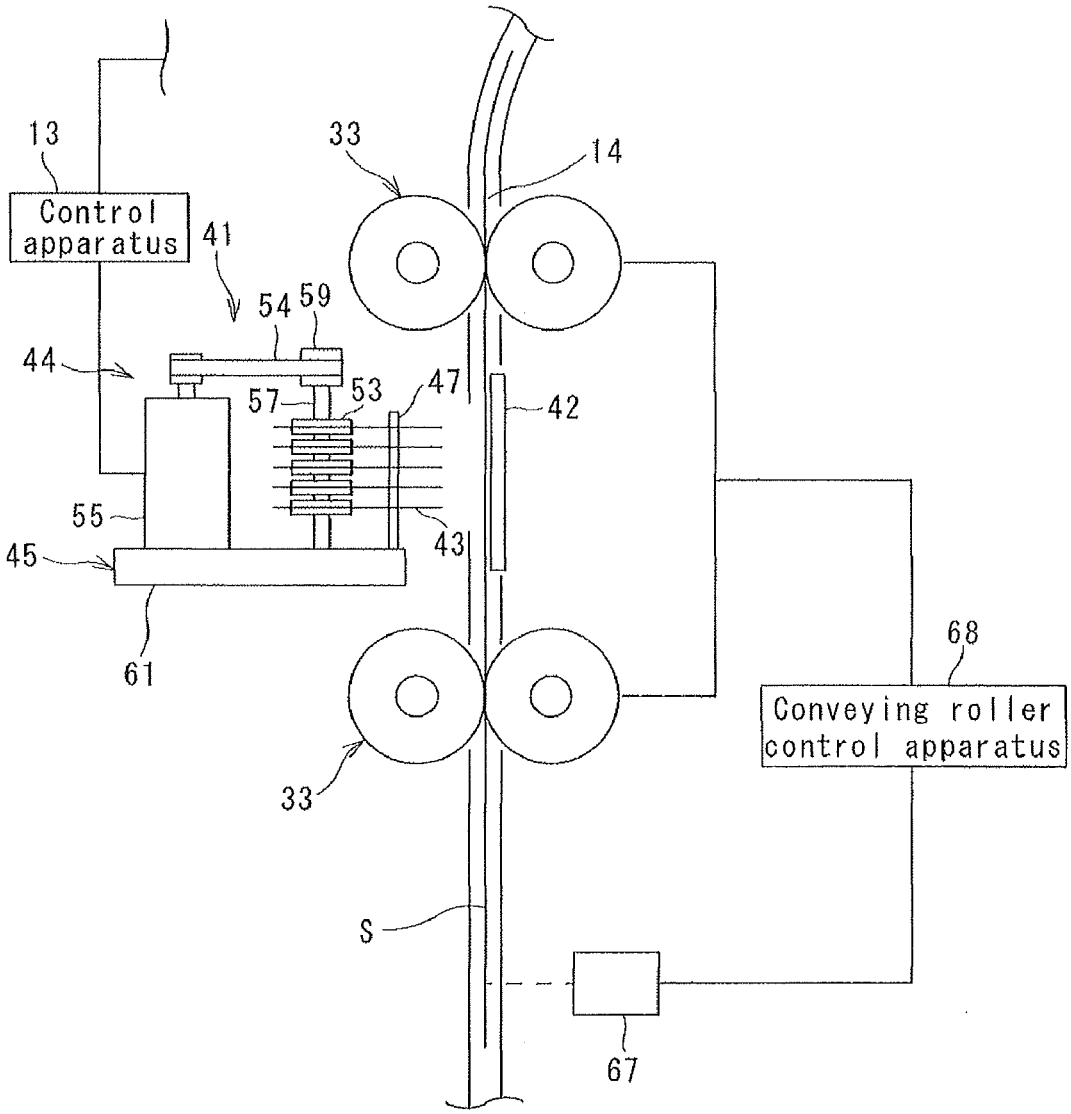
FIG. 2 is a partial enlarged side view of a ruling apparatus constituting the paper folding apparatus shown in FIG. 1.

The ruling apparatus 41 of the invention is provided downstream of the delivering rollers 32. As shown in FIG. 2, the ruling apparatus 41 is opposed to a backing plate 42 provided on the postprocessing apparatus 31 through a conveying path 14 for sheets S.

Figure 3:
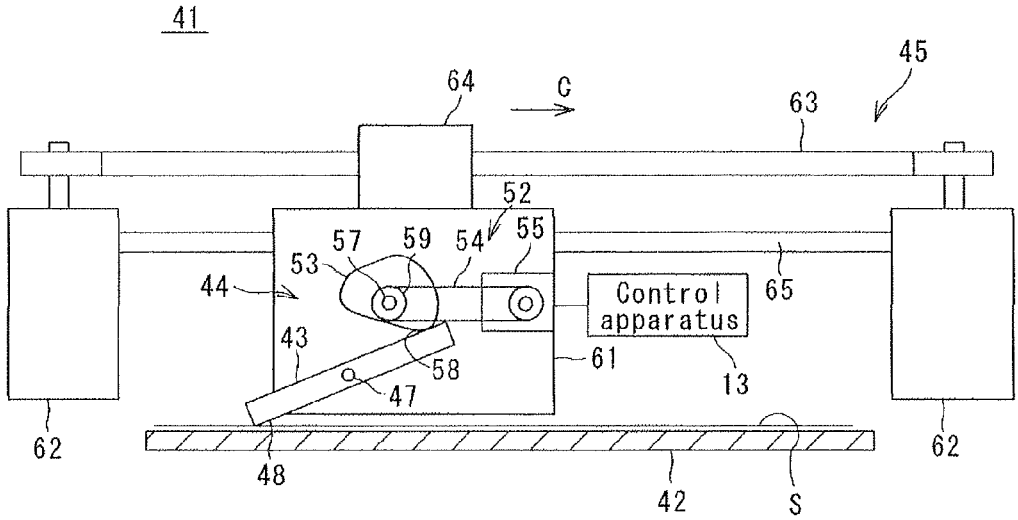
FIG. 3 is a plan view of the ruling apparatus shown in FIG. 2.

Referring to FIG. 3, the ruling apparatus 41 includes five pressing blades 43 that press the sheet S to rule a line 16, a swinging apparatus (swinging unit) 44 for swinging the pressing blade 43 from a pressing position where the pressing blade 43 presses the sheet S to a retracted position where the pressing blade 43 is retracted from the sheet S, and a moving apparatus (moving unit) 45 that moves the pressing blades 43 and the swinging apparatus 44 along the sheet S.

Figure 4:
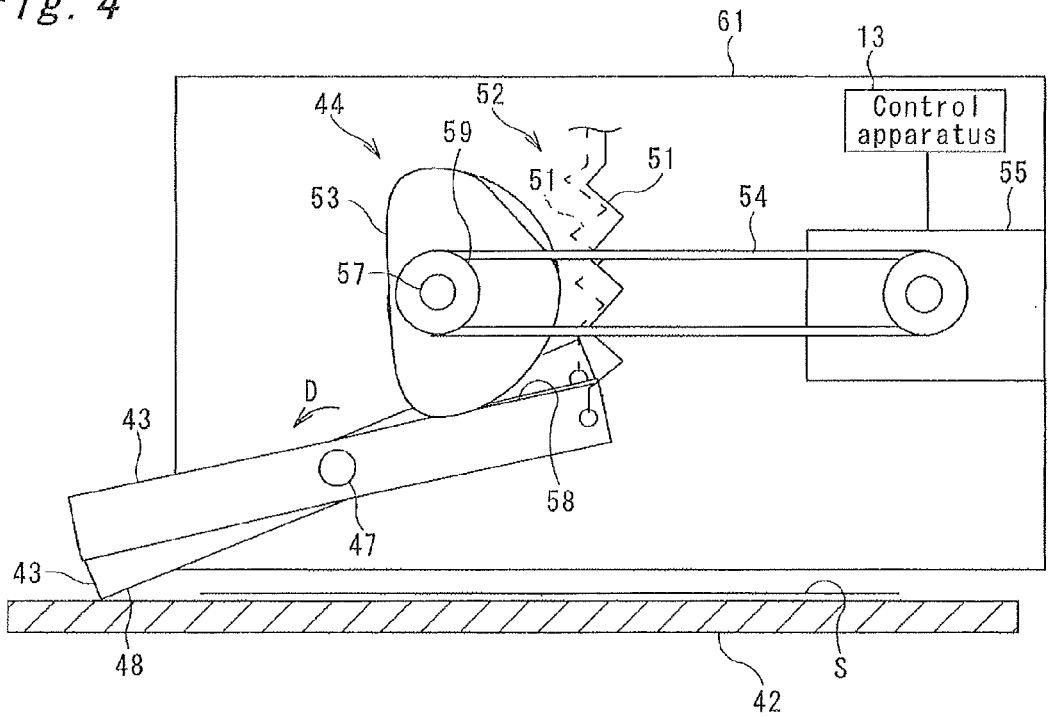
FIG. 4 is a partial enlarged plan view of a cam and a pressing blade shown in FIG. 3.
Figure 5:
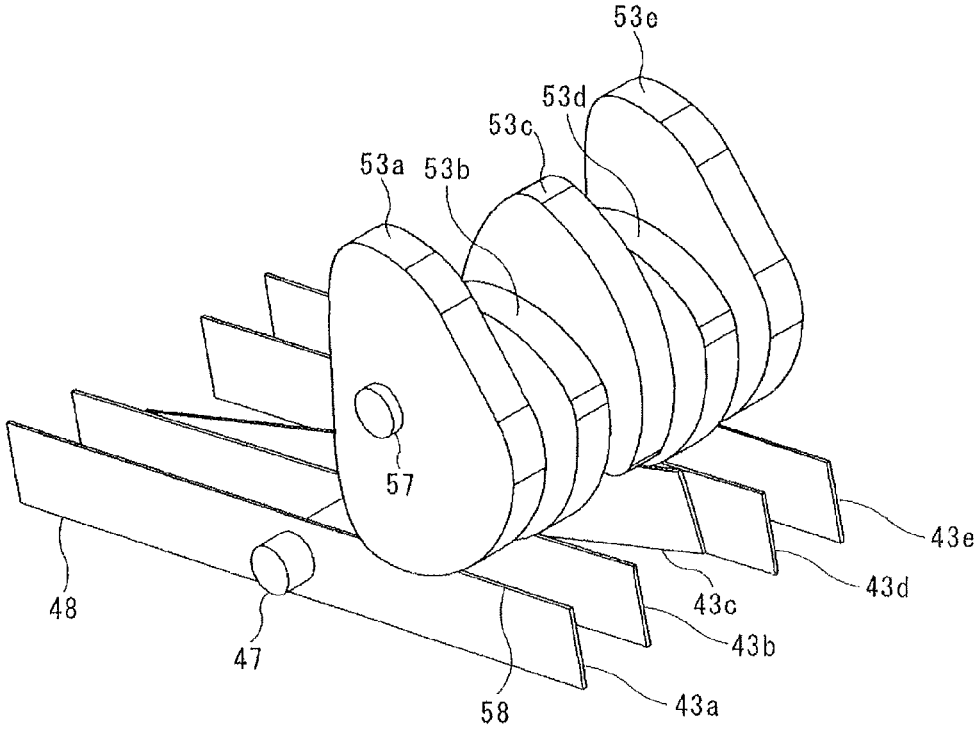
FIG. 5 is a perspective view of the cam and the pressing blade shown in FIG. 4 in a state where one pressing blade rules a line on a sheet of paper.

As shown in FIG. 4, the pressing blades 43 are opposed to the sheet S and rotatably provided around a shaft 47. Each of the pressing blades 43 is a known blade having a blade portion 48 formed on its tip end. The pressing blade 43 allows the blade portion 48 to press the sheet S, moves on the sheet S while coming into contact with the sheet S, thereby forming a line 16 on the sheet S. In this embodiment, as shown in FIG. 5, the five pressing blades 43 (43*a*, 43*b*, 43*c*, 43*d* and 43*e*) are disposed.

As shown in FIG. 4, the swinging apparatus 44 includes an extension spring 51 that is a resilient member for biasing the pressing blade 43 around the shaft 47 toward the sheet S, and a pressing blade driving apparatus (pressing blade driving unit) 52 that retracts the pressing blade 43 biased by the extension spring 51 from the sheet S.

One end of the extension spring 51 is mounted on a later-described mounting stage 61, and the other end of the extension spring 51 is connected to an opposite side of the pressing blade 43 from the blade portion 48. With this, the pressing blade 43 is biased toward the sheet S in a direction of an arrow D around the shaft 47.

The pressing blade driving apparatus 52 includes cams 53, and a pressing blade driving motor 55 that transmits a driving force to the cams 53 through a belt 54. The cams 53 are rotatably provided around a shaft 57. In this embodiment, as shown in FIG. 5, the five cams 53 (53*a*, 53*b*, 53*c* and 53*d*) are provided so as to abut against receiving surfaces 58 of the pressing blades 43.

A pulley 59 is provided on one end of the shaft 57 that passes through the five cams 53. The pulley 59 meshes with the belt 54 that follows the pressing blade driving motor 55 so that the cams 53 turn in accordance with the rotation of the pressing blade driving motor 55. The pressing blade driving motor 55 is connected to the control apparatus 13, and driven based on a signal from the control apparatus 13.

The moving apparatus 45 includes the mounting stage 61 on which the pressing blade driving motor 55 is mounted, and that is formed with two shafts 47 and 57 around which the pressing blade 43 and the cams 53 rotate, and a fixed portion 64 that is connected to the mounting stage 61 and that is fixed to a belt 63 wound between two belt driving motors 62 provided in the postprocessing apparatus 31. If the belt 63 is rotated by the belt driving motor 62, the moving apparatus 45 moves in accordance with a guide 65 provided on the postprocessing apparatus 31.

As shown in FIG. 2, the conveying rollers 33 sandwich the sheet S therebetween and convey the sheet S toward the downstream side. The conveying rollers 33 are controlled by a conveying roller control apparatus 68 based on a signal from a sheet detecting sensor 67 provided downstream.

Referring back to FIG. 1, a paddle 69 that rotates around a shaft is provided downstream of the ruling apparatus 41. The paddle 69 conveys the sheet S conveyed from the ruling apparatus 41 to the staple unit 36.

The stacker 34 is provided downstream from the staple unit 36, and collects a plurality of sheets S. The stacker 34 conveys, by a driving apparatus (not shown), a batch of sheets S in a direction of an arrow A from a staple position where the stacker 34 holds the sheet S that is stapled at a location downstream of the staple unit 36 to a pushing position where the stacker 34 holds the sheet S between the chopper 37 and the folding roller 38.

The staple unit 36 is provided downstream of the paddle 69. The staple unit 36 is a known unit including a needle-striking mechanism 36*a* and a needle-receiving mechanism 36*b*. If a predetermined number of sheets S are collected and positioned between the needle-striking mechanism 36*a* and the needle-receiving mechanism 36*b* by the stacker 34, the needle-striking mechanism 36*a* and the needle-receiving mechanism 36*b* are biased in a direction perpendicular to the sheet-conveying direction by a driving unit (not shown), and the staple operation is carried out by this biasing motion.

Figure 11:
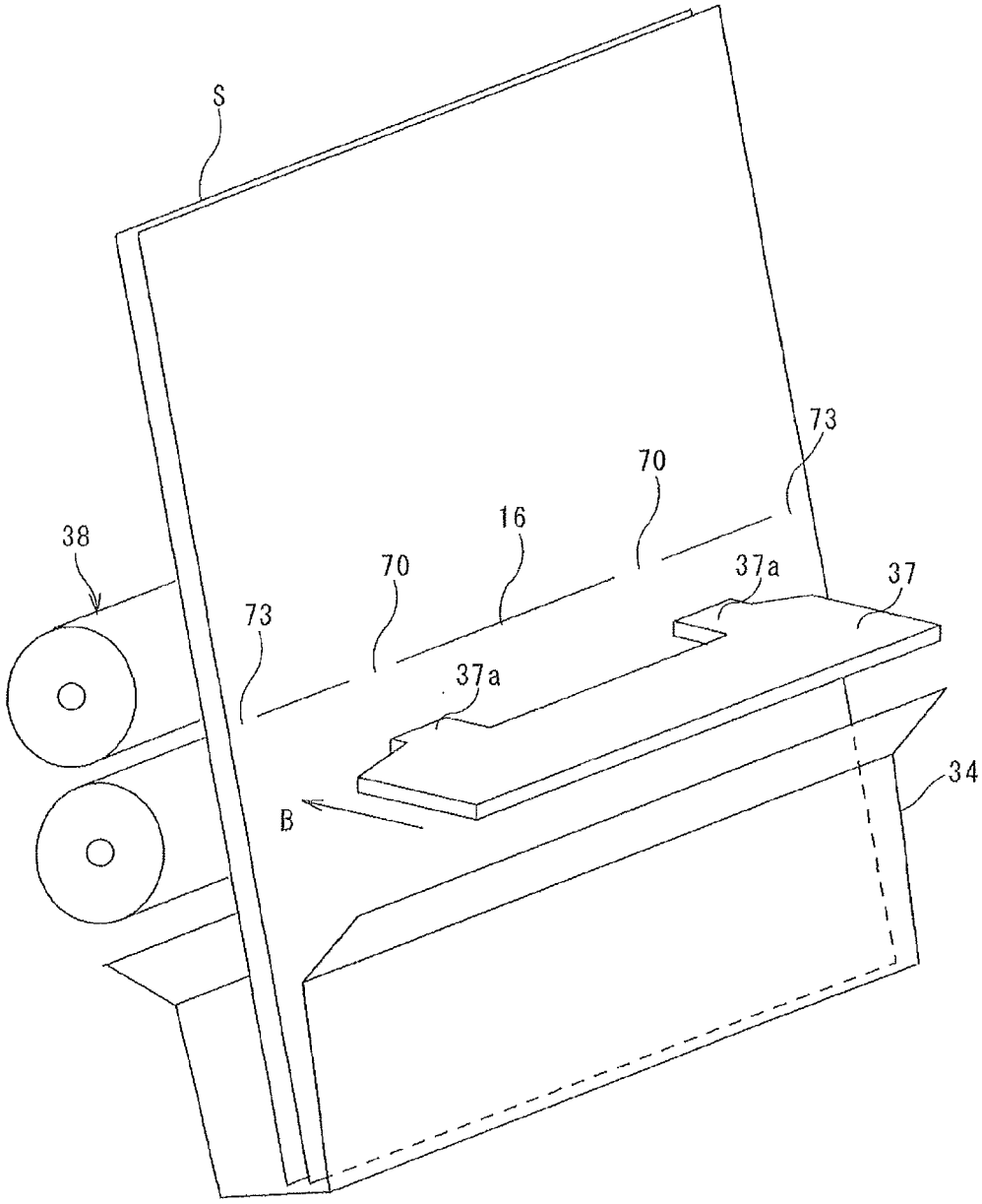
FIG. 11 is a perspective view of a state before a chopper of the embodiment of the invention pushes a sheet having one line.

The chopper 37 is provided most downstream of the postprocessing apparatus 31 together with the folding roller 38. The chopper 37 is of a plate form, and includes two pushing portions 37*a* for partially pushing the sheet S toward the folding roller 38 as shown in FIG. 11. The chopper 37 is moved by a driving apparatus (not shown) in a direction of an arrow B so that the pushing portion 37*a* pushes a staple position 70 of the sheet S toward the folding roller 38.

The pair of folding rollers 38 are known rollers rotatable around shafts. The sheet S of which the staple portion 70 is pushed is by the chopper 37 is pressed by the folding roller 38 and conveyed. With this, central portions of the sheets S are pushed and bent and formed into a booklet, and the booklet is discharged into the output tray 39.

The output tray 39 is provided such that an operator takes the booklet with his or her hand from outside of the postprocessing apparatus 31.

Next, operations of the paper folding apparatus having the above-described configuration, and the postprocessing apparatus 31 using the paper folding apparatus will be described.

A sheet S on which an image was formed is conveyed from the image forming apparatus 11, and is introduced into the postprocessing apparatus 31 from an inlet 15. The sheet S introduced into the postprocessing apparatus 31 is delivered to a downstream side by the delivering rollers 32, and passes between the ruling apparatus 41 and the backing plate 42. At that time, if the sheet detecting sensor 67 detects a tip end of the conveyed sheet S, the conveying rollers 33 stop rotating based on a signal from the conveying roller control apparatus 68, and sandwich and hold the sheet S.

If the control apparatus 13 connected to the main body 21 determines that the sheet S that is being held is a top surface or a bottom surface (innermost surface or outermost surface) of a booklet, the control apparatus 13 drives the pressing blade driving motor 55 such that only one pressing blade 43*c* pushes the sheet S as shown in FIG. 5. At that time, as shown in FIG. 11, all of the pressing blades 43 are retracted from the sheet S at the edge 73 of the sheet S, and the pressing blade 43*c* is pressed against the sheet S at a location other then the edge 73. While the pressing blade 43*c* is pressed against the sheet S at the location other than the edge 73, the pressing blade 43*c* is moved in a direction of an arrow C by the moving apparatus 45, thereby ruling a line 16. At the opposite edge 73 of the sheet S, the pressing blade 43*c* is retracted from the sheet S in the same manner as that described above. The edge 73 of the sheet S means a region of a 5 mm width inward from an outer frame of the sheet S. If the pressing blade 43*c* is retracted at the edge 73, when a line 16 is formed on the edge 73 of the sheet S, it is possible to prevent the edge 73 from curling up when the pressing blade 43 rides over the edge 73, and the sheet S from being damaged. Since only one line 16 is formed on the sheet S constituting the top surface or bottom surface of a booklet, it is possible to enhance the appearance of the booklet.

Figure 6:
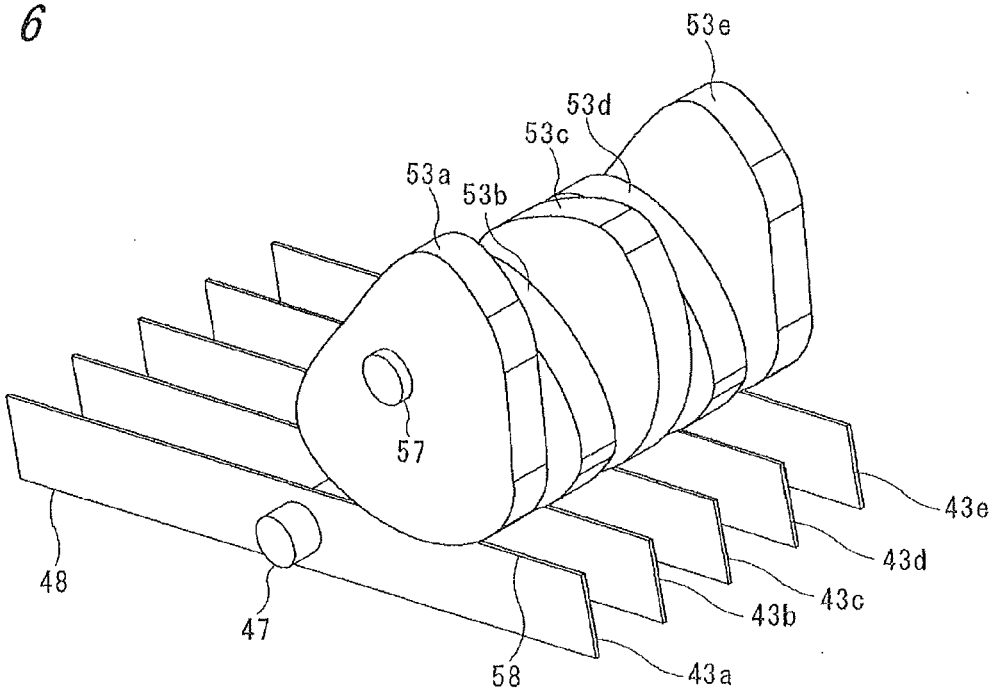
FIG. 6 is a perspective view of a state where all of the pressing blades are retracted from the sheets at a staple position from the pressing blades shown in FIG. 5.

As shown in FIG. 11, the pressing blade 43*c* may be retracted at the staple position 70 where the staple operation is carried out (see FIG. 6). With this, the pressing force of the folding roller 38 is increased when the batch of sheets is folded, and it is possible to prevent the sheets S from being damaged at the staple position 70.

To further enhance the appearance of sheets 5, it is possible to employ such a configuration that if it is determined that a sheet S that is being held is the top surface or the bottom surface of a booklet, all of the pressing blades 43 are retracted from the sheets S, and the moving apparatus 45 is not moved so that the lines 16 are not formed.

Figure 15:
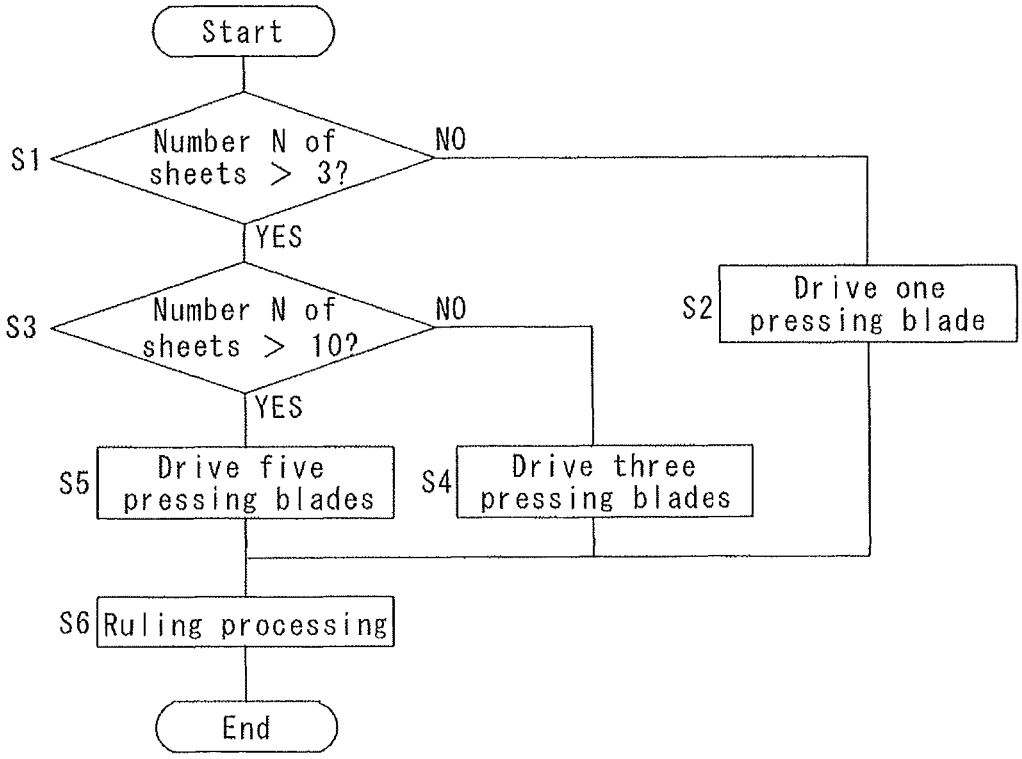
FIG. 15 is a flowchart of action of ruling processing according to the embodiment of the invention.

If it is determined that the sheet S that is being held is a sheet other than the top surface or the bottom surface of a booklet, the control apparatus 13 detects the number N of a the batch of sheets S constituting a booklet. As shown in a flowchart in FIG. 15, it is detected in step S1 whether the number N of the batch of sheets is greater than three that is a first threshold value. When the number is not greater than three, the procedure is advanced to step S2, where one pressing blade 43*c* is pressed against the sheet S, and the ruling processing is carried out in step S6. With this, when the number of sheets is small, the number of lines 16 to be ruled on the sheets S is reduced to enhance the appearance.

Figure 7:
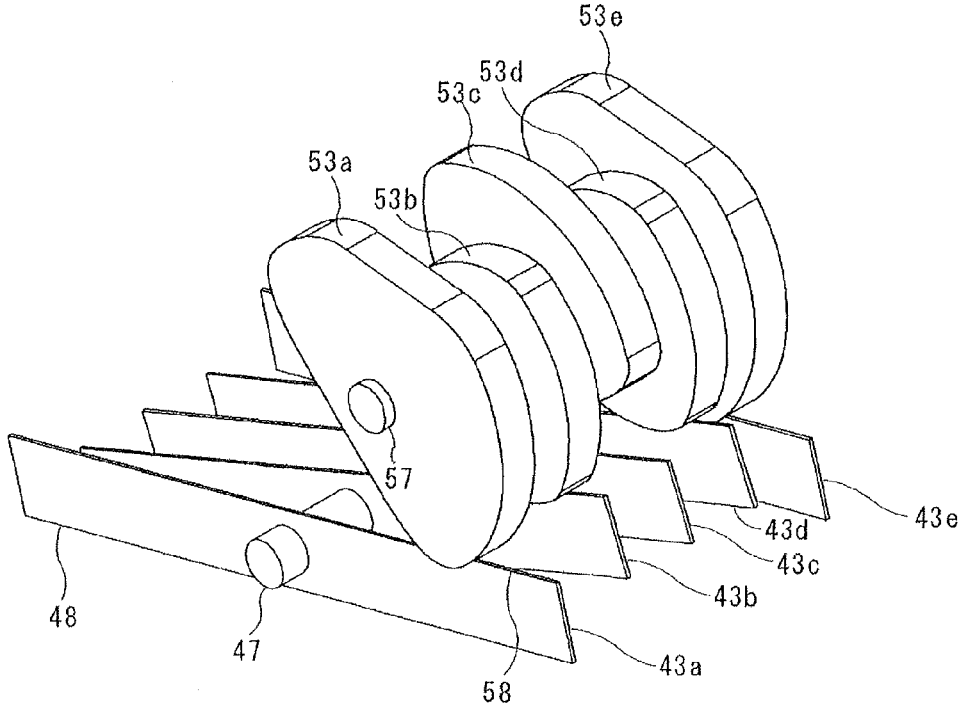
FIG. 7 is a perspective view of the cams and pressing blades shown in FIG. 4 in a state where three pressing blades rule lines on a sheet.

When the number N of sheets of the batch detected in step S 1 is greater than three, the procedure is advanced to step S3, where it is detected whether the number N of the batch of sheets is greater than 10 that is a second threshold value. If the number N is not greater than 10, the procedure is advanced to step S4, the three pressing blades 43*b*, 43*c* and 43*d* are pressed against the sheets S as shown in FIG. 7, and the ruling processing is carried out in step S6.

Figure 8:
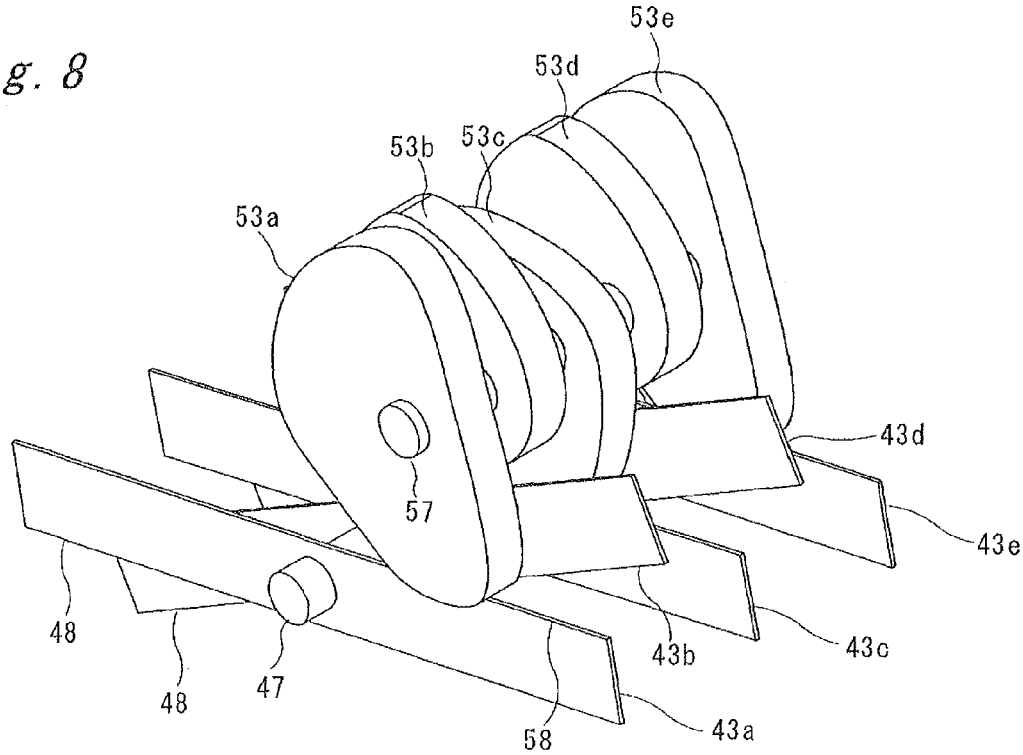
FIG. 8 is a perspective view of a state where middle one of the pressing blades is retracted from the sheet at the staple position from the pressing blades shown in FIG. 7.
Figure 9:
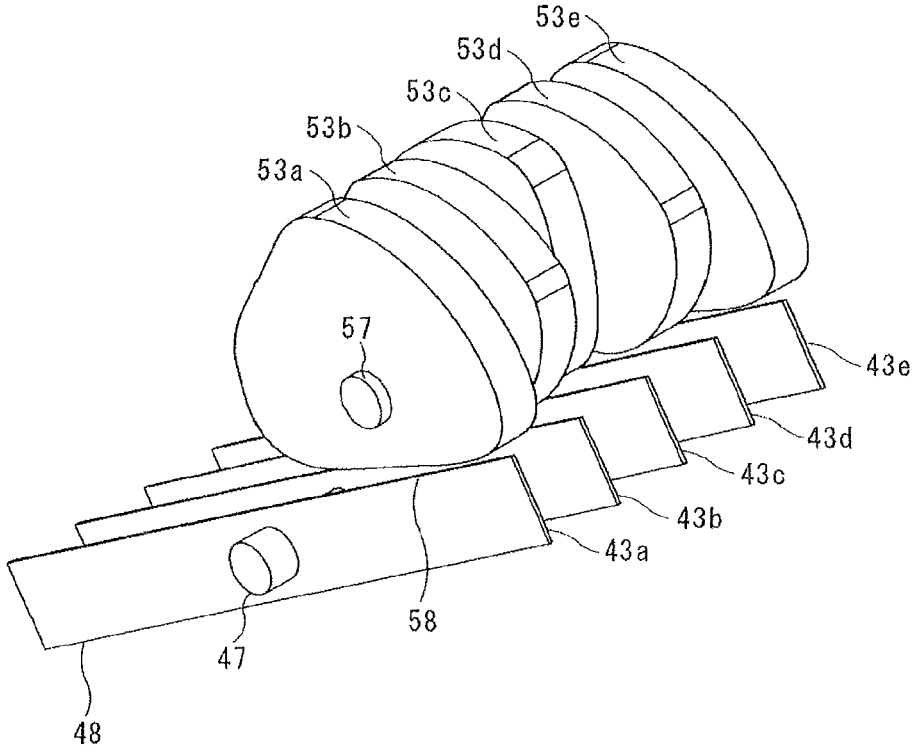
FIG. 9 is a perspective view of the cams and pressing blades shown in FIG. 4 in a state where five pressing blades rule lines on a sheet.
Figure 12:
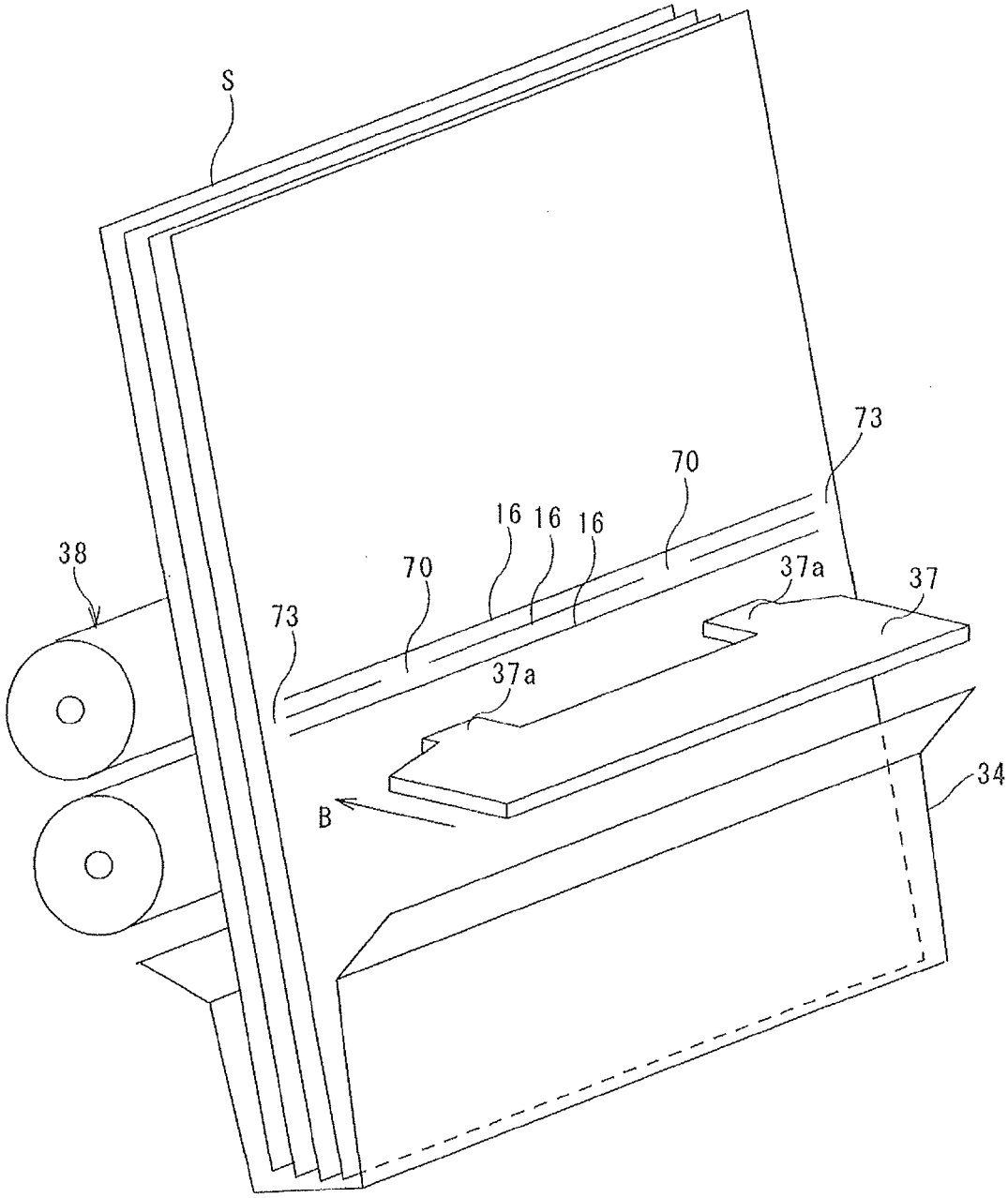
FIG. 12 is a perspective view of a state before the chopper of the embodiment of the invention pushes a sheet having three lines.

At that time, as shown in FIG. 12, among the three pressing blades 43*b*, 43*c* and 43*d*, middle one of them, i.e., the pressing blade 43*c* is retracted in the staple position where the staple processing is carried out (see FIG. 8) and with this, the same effect as that described above can be obtained.

When the number N of sheets of the batch detected in step S3 is greater than 10, the procedure is advanced to step S5, where the five pressing blades 43*a*, 43*b*, 43*c*, 43*d* and 43*e* are pressed against the sheets S, and the ruling processing is carried out in step S6. With this, when the number N of sheets is great, the number of lines 16 formed on the sheets S is increased. Therefore, even if the sheets S are bound and folded to be formed into a booklet, the swelling of the booklet can be reduced. The upper limit of the number N of sheets of the batch is 20 for example.

Figure 10:
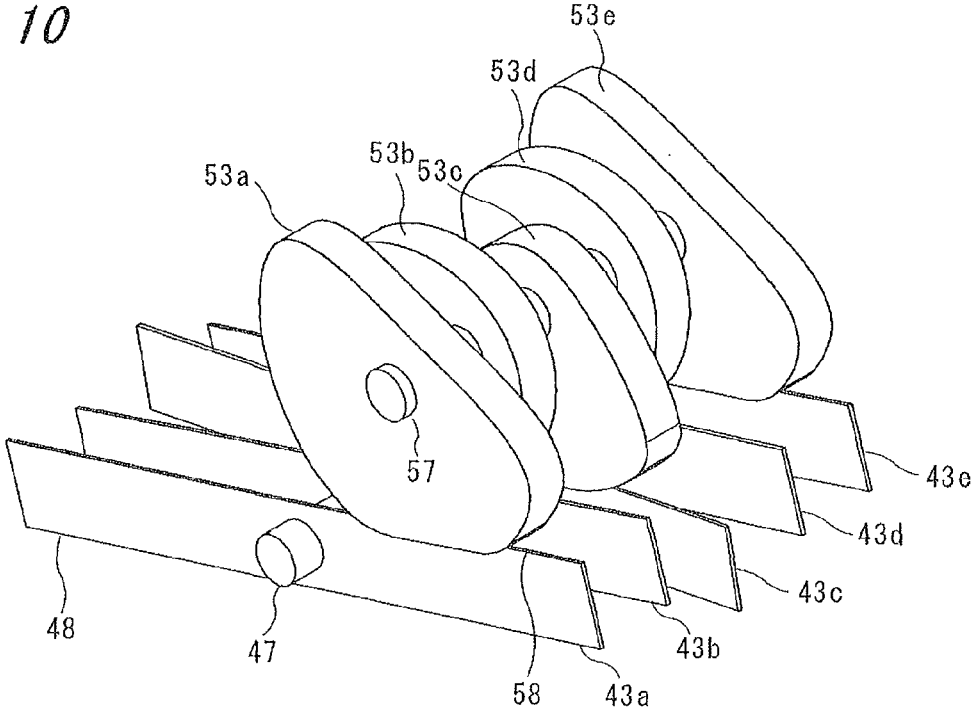
FIG. 10 is a perspective view of a state where the pressing blades are retracted from the sheet at the staple position from the pressing blades shown in FIG. 9.

At that time, in the staple position 70 where the staple processing is carried out, the middle pressing blade 43*c* of the five pressing blades 43*a*, 43*b*, 43*c*, 43*d* and 43*e* is retracted in the same manner as that described above (see FIG. 10). With this, the same effect can be obtained. However, only if the number of lines 16 is reduced at the staple position 70, it is possible to employ such a configuration that middle three pressing blades 43*b*, 43*c* and 43*d* of the five pressing blades 43*a*, 43*b*, 43*c*, 43*d* and 43*e* are retracted in the staple position 70.

As apparent from the above-described motion, since the number of pressing blades 43 against which sheets S are pressed is changed in accordance with the number of sheets S to be bound, when a small number of sheets S is bound as a batch, the number of lines 16 is reduced to enhance the appearance; and when a large number of sheets S are bound as a batch, the number of lines 16 is increased to form the sheets as a booklet. Therefore, even if sheets are bound as a batch and folded, the swelling of the booklet can be reduced. With this, it is possible to form ease-of-use booklets having excellent appearance and many booklets can be loaded. Further, since the five pressing blades 43 are provided with the cams 53, respectively, the pressing blades 43 can individually be driven, and the number of lines 16 to be formed on sheets S can be changed.

The sheets S on which lines 16 were formed are conveyed to a downstream side by the conveying rollers 33 and the paddle 69, the sheets S are collected by the stacker 34 through the staple unit 36 and positioned therebetween. If a predetermined number of sheets S are collected by the stacker 34, the staple processing is carried out by the needle-striking mechanism 36*a* and the needle-receiving mechanism 36*b* of the staple unit 36.

Figure 13:
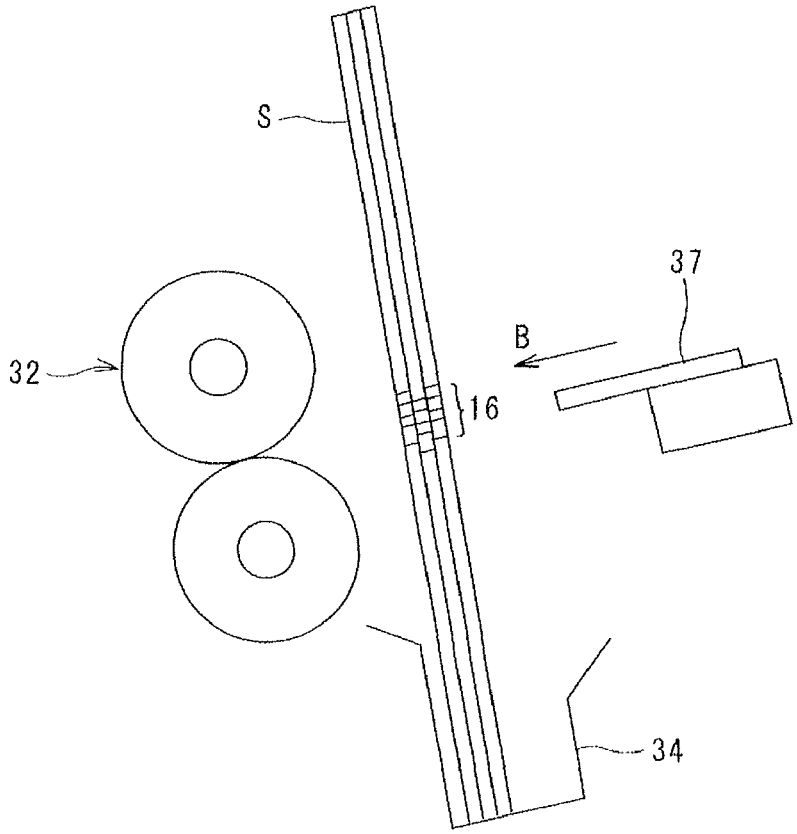
FIG. 13 is a perspective view of a state before the chopper shown in FIG. 11 pushes a sheet having five lines.
Figure 14:
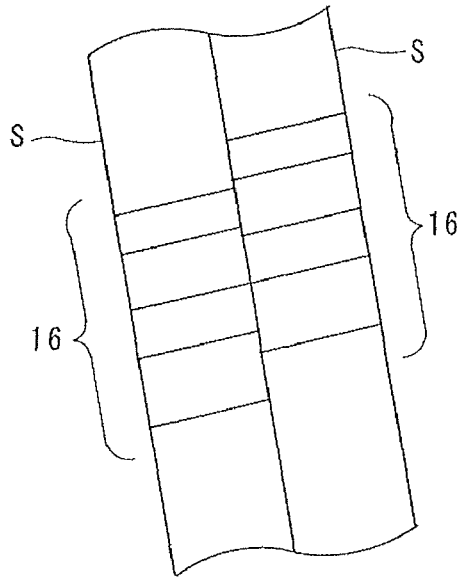
FIG. 14 is a partial enlarged side view of a sheet having the lines shown in FIG. 13.

Next, the stacker 34 moves in the direction of the arrow A, and stops below the folding roller 38. The chopper 37 moves in the direction of the arrow B as shown in FIG. 13, and the pushing portion 37*a* pushes a staple position 70 of the sheet S toward the folding roller 38. With this, the ruling effect can be enhanced as compared with a case where the chopper 37 pushes the entire width of the sheet S. Since a plurality of lines 16 are formed on the sheets S as shown in FIG. 14, even if the entire lines 16 are deviated in the vertical direction, if one of the lines 16 is aligned with others, it is possible to enhance the batch bending effect and to reduce the swelling of the booklet. The pushed sheets S are in contact with the folding roller 38 under pressure and conveyed so that the folding processing is carried out, and the booklet is discharged into the output tray 39.

The paper folding apparatus of the invention is not limited to the embodiment. The number of pressing blades 43 is not limited to five only if the pressing blades 43 can form a plurality of lines 16 on a sheet S and the number of pressing blades 43 that press a sheet S can be changed in accordance with the number of sheets to be bound.

As clear from above description, it is an object of the invention to provide a paper folding apparatus capable of forming ease-of-use booklets having excellent appearance. According to the paper folding apparatus, even if the number of a batch of sheets is increased, the swelling of the booklet can be reduced and thus, many booklets can be loaded. It is also an object of the invention to provide a postprocessing apparatus using the paper folding apparatus.

A paper folding apparatus of the present invention includes:

a ruling unit that rules a line on each of sheets discharged from an image forming apparatus, a pushing unit that pushes the sheets on which the lines are ruled by the ruling unit, and a pair of folding rollers that comes into contact under pressure with the sheets pushed by the pushing unit and discharges the sheets, wherein the ruling unit includes a plurality of pressing blades for ruling a line on each of the sheets, a swinging unit that swings the pressing blades from a pressing position where the pressing blade presses the sheets to a retracted position where the pressing blades are retracted from the sheets, and a moving unit that moves the pressing blades and the swinging unit along the sheets.

According to the invention, since the ruling unit includes the plurality of pressing blades, even if the number of a batch of sheets is increased, the plurality of pressing blades presses the sheets so that a plurality of lines can be formed. With this, even if sheets are bound and folded to form a booklet, swelling of the booklet can be reduced, and it is possible to form an ease-of-use booklets having excellent appearance, and many booklets can be loaded.

Further, since the plurality of pressing blades swing between the pressing position where the pressing blades press the sheets and the retracted position where the pressing blades are retracted from the sheets, the number of lines formed on the sheets can be changed, and the optimal number of lines can be formed in accordance with a situation.

It is preferable that the number of the plurality of pressing blades is five, and the plurality of pressing blades are provided at equal distances from one another With this, since the sheets are pressed and lines are formed symmetrically with respect to the pressing blade located at a center, the appearance of the booklet can be enhanced.

It is preferable that the swinging unit includes a resilient member that biases the pressing blades toward the sheet and presses the sheet, and a pressing blade driving unit that retracts the pressing blades biased by the resilient member from the sheet, and the number of the pressing blades that press the sheet is changed by the resilient member and the pressing blade driving unit in accordance with a number of sheets to be bound.

Since the number of pressing blades that press the sheet is changed in accordance with the number of sheets to be bound, when a small number of sheets is to be bound, the number of lines is reduced to enhance the appearance, and when a large number of sheets is to be bound, the number of lines is increased. Therefore, even if the sheets are bound and folded to form a booklet, the swelling of the booklet can be reduced.

When the number of sheets to be bound is smaller than the first threshold value, it is preferable that one of the pressing blades presses the sheets.

With this, it is possible to reduce the number of lines formed on the sheets, and to enhance the appearance.

When the number of sheets to be bound is equal to or greater than the first threshold value and smaller than the second threshold value, it is preferable that three of the pressing blades press the sheets.

When the number of sheets to be bound is equal to or greater than second threshold value, it is preferable that the five pressing blades press the sheets.

With this, the number of lines formed on the sheets is increased and the swelling of the booklet can be reduced.

It is preferable that the pressing blade driving unit includes cams as many as the pressing blades.

In this case, it is preferable that the number of the cams is five.

With this, the cams are provided on the five pressing blades, respectively, and the pressing blades can individually be driven.

It is preferable that with respect to a sheet of a top surface or a bottom surface of a plurality of sheets constituting a booklet, all of the pressing blades are retracted, or one of the pressing blades presses the sheets.

With this, the appearance of the booklet can be enhanced.

It is preferable that the pressing blade is retracted from the sheet at the edge of the sheet, and the pressing blade is pressed against the sheet at a location other than the edge.

With this, no line is formed on the edge of the sheet. Therefore, when a line is formed on an edge of a sheet, the edge of the sheet curls up and this prevents the sheet from being damaged when the pressing blade rides over the edge of the sheet.

It is preferable that a pair of conveying rollers are provided each of upstream and downstream of the ruling unit, and the ruling unit rules a line on the sheet in a state where the pair of conveying rollers hold the sheet.

It is preferable that in a postprocessing apparatus having the paper folding apparatus, a staple unit that staples a batch of sheets is provided downstream of the paper folding apparatus, and the pressing blade is retracted from the sheet at a position of staple.

With this, when the batch is folded, since a pressing force of the folding roller is high, it is possible to prevent the sheet from being damaged at the staple position.

According to the invention, since the ruling unit includes the plurality of pressing blades, even if the number of a batch of sheets is increased, the plurality of pressing blades press the sheets and a plurality of lines can be formed. With this, even if sheets are bound and folded to form a booklet, swelling of the booklet can be reduced, and it is possible to form an ease-of-use booklets having excellent appearance, and many booklets can be loaded. Further, since the plurality of pressing blades swing between the pressing position where the pressing blades press the sheets and the retracted position where the pressing blades are retracted from the sheets, the number of lines formed on the sheets can be changed, and the optimal number of lines can be formed in accordance with a situation.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. A paper folding apparatus comprising a ruling unit that rules a line on each of sheets, a pushing unit that pushes the sheets on which the lines are ruled by the ruling unit, and a pair of folding rollers that comes into contact under pressure with the sheets pushed by the pushing unit and discharges the sheets, wherein the ruling unit includes a plurality of pressing blades for ruling a line on each of the sheets, a swinging unit that swings the pressing blades from a pressing position where the pressing blade presses the sheets to a retracted position where the pressing blades are retracted from the sheets, and a moving unit that moves the pressing blades and the swinging unit along the sheets.

2. The paper folding apparatus according to claim 1, wherein the number of the plurality of pressing blades is five, and the plurality of pressing blades are provided at equal distances from one another.

3. The paper folding apparatus according to claim 1, wherein the swinging unit includes a resilient member that biases and presses the pressing blades against the sheets, and a pressing blade driving unit that retracts the pressing blades biased by the resilient member from the sheets, and the number of pressing blades that press the sheets is changed by the resilient member and the pressing blade driving unit in accordance with the number of sheets to be bound.

4. The paper folding apparatus according to claim 3, wherein the pressing blade driving unit includes cams as many as the pressing blades.

5. The paper folding apparatus according to claim 4, wherein the number of the cams is five.

6. The paper folding apparatus according to claim 1, wherein when the number of sheets to be bound is smaller than a first threshold value, one of the pressing blades presses the sheets.

7. The paper folding apparatus according to claim 1, wherein when the number of sheets to be bound is equal to or greater than a first threshold value and smaller than a second threshold value, three of the pressing blades press the sheets.

8. The paper folding apparatus according to claim 1, wherein when the number of sheets to be bound is equal to or greater than a second threshold value, five of the pressing blades press the sheets.

9. The paper folding apparatus according to claim 1, wherein with respect to a sheet of a top surface or a bottom surface of a plurality of sheets constituting a booklet, all of the pressing blades are retracted, or one of the pressing blades presses the sheets.

10. The paper folding apparatus according to claim 1, wherein the pressing blade is retracted from the sheet at an edge of the sheet, and the pressing blade presses the sheet at a location other than the edge.

11. The paper folding apparatus according to claim 1, further comprising a pair of conveying rollers provided each of upstream and downstream of the ruling unit, wherein the ruling unit rules a line on the sheet in a state where the pair of conveying rollers hold the sheet.

* * * * *